US006086675A

United States Patent [19]

Hamamoto et al.

[11] Patent Number: 6,086,675

[45] Date of Patent: Jul. 11, 2000

[54] WEB CHARGING APPARATUS

[75] Inventors: Nobuo Hamamoto; Kenji Kojima, both of Minami-Ashigara, Japan

[73] Assignee: Fuji Photo Film Co., Ltd., Kanagawa, Japan

[21] Appl. No.: 09/074,387

[22] Filed: May 8, 1998

[30] Foreign Application Priority Data

May 13, 1997 [JP] Japan ..... 9-122621

[51] Int. Cl.[7] ..... B05D 3/14

[52] U.S. Cl. ..... 118/620; 118/624; 118/625

[58] Field of Search ..... 361/225, 226, 361/229, 230; 399/310, 311, 313, 315, 316, 170, 172, 161; 118/620, 641, 624, 625, 627; 250/325

[56] References Cited

U.S. PATENT DOCUMENTS

| | | | |
|---|---|---|---|
| 3,390,266 | 6/1968 | Epping . | |
| 3,612,864 | 10/1971 | Tamai et al. . | |
| 3,783,283 | 1/1974 | Smith, Jr. . | |
| 3,937,960 | 2/1976 | Matsumoto et al. | 250/325 |
| 4,322,156 | 3/1982 | Kohyama | 250/325 |
| 4,326,794 | 4/1982 | Nishimura | 399/168 |
| 4,486,808 | 12/1984 | Cardone . | |
| 5,018,045 | 5/1991 | Myochin et al. . | |
| 5,138,971 | 8/1992 | Nakajima et al. . | |
| 5,367,366 | 11/1994 | Kido et al. | 399/315 |
| 5,373,351 | 12/1994 | Umeda et al. | 399/66 |

FOREIGN PATENT DOCUMENTS

| | | |
|---|---|---|
| 2073907 | 10/1971 | France . |
| 4-65088 | 3/1992 | Japan . |

*Primary Examiner*—Laura Edwards
*Attorney, Agent, or Firm*—Sughrue, Mion, Zinn, Macpeak & Seas, PLLC

[57] ABSTRACT

A web charging apparatus comprises wire electrodes, which are extended along the width of a moving web, and a grounded roller, on which the web is supported. A grounded plate is provided behind the wire electrodes relative to the grounded roller, so that the electrostatic potential at both widthwise ends of the web can be equal to the electrostatic potential at the central part of the web.

14 Claims, 7 Drawing Sheets

WEB CHARGING APPARATUS

BACKGROUND OF THE INVENTION

1. Field of the Invention

The present invention relates to a web charging apparatus that deposits electrostatic charges on a moving web and is provided preceding to a coating apparatus, which coats the web with a variety of coating solutions in order to manufacture photographic film, photographic printing paper, printing photosensitive materials, medical photosensitive materials, microfilm, magnetic recording tape, adhesive tape, pressure sensitive paper, thermal paper, offset printing plate materials, etc.

2. Description of the Related Art

U.S. Pat. No. 5,138,971 which corresponds to Japanese Patent Provisional Publication No. 4-65088 discloses that a web charging apparatus is provided preceding to a coating apparatus, so as to improve the affinity and adhesion of the coating solution to the web by depositing unipolar electrostatic charges on the surface of the web before the coating solution is applied on the surface. In the web charging apparatus, corona discharge is established between wire electrodes, which are extended in a widthwise direction of the web, and the web that is supported on a grounded roller functioning as a grounded electrode relative to the wire electrodes, so that the unipolar electrostatic charges can be deposited on the web. Thereby, the coating solution can be easily applied on the web at the start of the coating, and it is also possible to prevent the coating solution from being applied too thickly. Moreover, it is also possible to prevent the coating solution from being disturbed when a web splicing part is coated. Hence, the coating method utilizing the electrostatic field has usually been adopted to a variety of coating apparatues.

Recently, the web is coated with the coating solution while moving at high speed, and it has been found that the electrostatic potential at both widthwise ends of the web is lower than the electrostatic potential at the other area of the web when the unipolar electrostatic charges are deposited on the surface of the web that moves at high speed. Both widthwise ends of the web with the low electrostatic potential will be referred to as "edge parts of the web", and the other area of the web will be referred to as "the central part of the web". For this reason, when the coating solution is applied on the web, the affinity and adhesion of the coating solution on the edge parts of the web are much worse than those on the central part of the web.

To solve the above-mentioned problem, U.S. Pat. No. 5,138,971 discloses the web charging apparatus in which the distance between the wire electrode and each edge part of the web is shorter than the distance between the wire electrode and the central part of the web.

In the above-mentioned case, however, the distance between the wire electrode and the web must be finely adjusted by less than 1mm. Even if the distance between the wire electrode and the web can be adjusted as desired, the wire electrode easily sags, and thereby, the electrostatic potential at the edge parts of the web becomes lower than the electrostatic potential at the central part of the web. Thus, so-called "liquid exhaustion at the edge parts of the web" arises in that the edge parts of the web cannot satisfactorily be coated compared with the central art of the web.

SUMMARY OF THE INVENTION

The present invention has been developed in view of the above-described circumstances, and has as its object the provision of the web charging apparatus which is able to uniformly deposit the unipolar electrostatic charges on the whole width of the web, thereby equalizing the affinity and adhesion of the coating solution on the edge parts and the central part of the web.

To achieve the above-mentioned object, a web charging apparatus according to the present invention comprises: a first grounded electrode being in contact with a first surface of a moving web; a discharge electrode facing the first grounded electrode across the web; a second grounded electrode arranged behind the discharge electrode relative to the first grounded electrode; and is characterized in that corona discharge is established between the first grounded electrode and the discharge electrode via the web by which electrostatic charges are deposited on a second surface of the web.

According to the present invention, the second grounded electrode is arranged behind the discharge electrode relative to the first grounded electrode, so that the electrostatic charges can be uniformly deposited on the whole width of the web. Thus, it is possible to equalize the affinity and adhesion of the coating solution applied on the edge parts and the central part of the web, so that the coating solution can be uniformly applied on the whole width of the web.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

Figure 1:
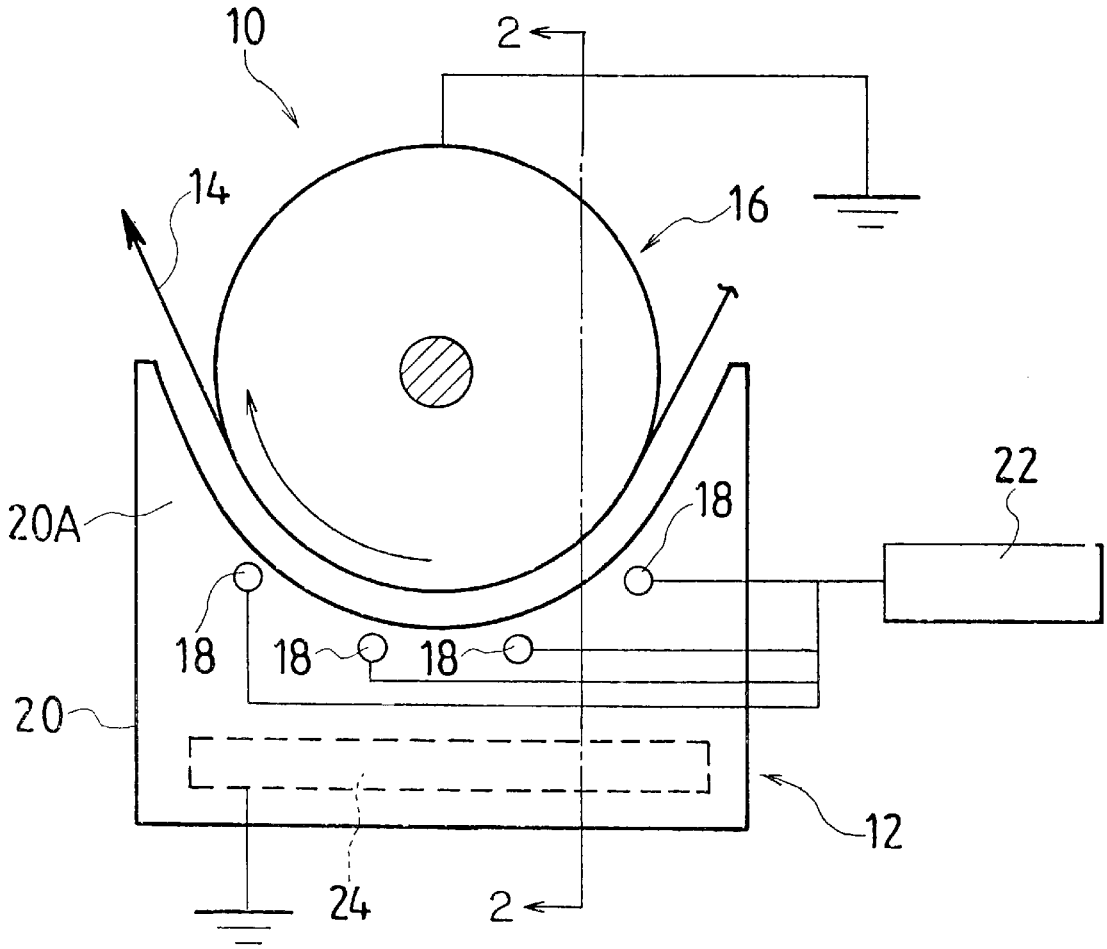
FIG. 1 is a side view of assistance in explaining the first embodiment of the web charging apparatus according to the present invention.
Figure 2:
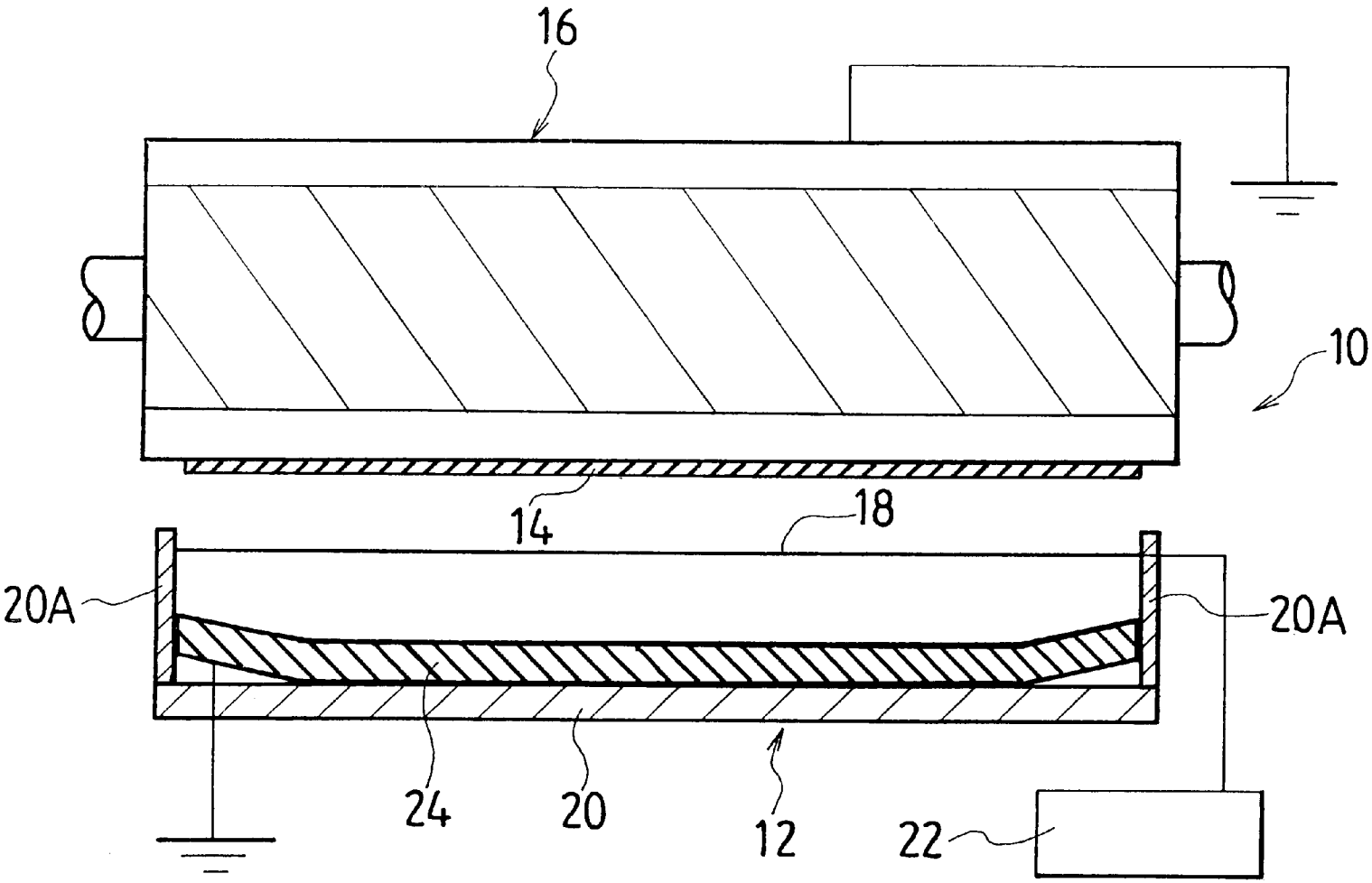
FIG. 2 is a front sectional view taken along a line A—A of FIG. 1.

FIG. 1 is a side view of assistance in explaining the first embodiment of a web charging apparatus according to the present invention. FIG. 2 is a front sectional view taken along the line A—A of FIG. 1.

As shown in FIGS. 1 and 2, the web charging apparatus 10 comprises a discharge electrode device 12 and a first grounded electrode or a roller 16 that is grounded and provided above the discharge electrode device 12. The roller 16 serves both as a counter electrode for corona discharge and a supporting roller for a moving web 14.

The discharge electrode device 12 includes discharge electrodes or wire electrodes 18, which are supported in tension between side plates 20A of an electrode supporting frame 20 and are parallel to the axis of the roller 16A plurality of (e.g. four) wire electrodes 18 are arranged in parallel to each other at regular intervals on a circle concentric with the roller 16, in other words, the wire electrodes 18 are arranged along the path of the web 14. The wire electrodes 18 are made from a conductive material, e.g. tungsten, molybdenum, platinum, and carbon fiber, and preferably have a diameter of about 100 $\mu$m to about 200 $\mu$m. Each side plate 20A of the electrode supporting frame 20 is provided with stretchers (not shown), each of which supports an end of one of the wire electrodes 18 and can adjust a tensile force of the wire electrode 18. The wire electrodes 18 are preferably stretched under a tensile force of about 10N. As shown in FIG. 1, each side plate 20A has a curve along the periphery of the roller 16.

On the other hand, the web 14 moves over the roller 16 while being in contact with the outer surface of the roller 16, which is grounded to function as the counter electrode. The distance between each wire electrode 18 and the web 14 supported on the roller 16 is about 10 mm.

The wire electrodes 18 are connected to a source 22 of direct voltage of about 6500V, and the corona discharge is established between the wire electrodes 18 and the roller 16 via the web 14.

In the electrode support frame 20, a second grounded electrode or a grounded plate 24 is arranged behind the wire electrodes 18 relative to the roller 16. The grounded plate 24 is grounded and is a rectangle whose length is substantially equal to the length of the wire electrodes 18 and whose width is substantially equal to the diameter of the roller 16. As shown in FIG. 2, both lengthwise (widthwise of the web 14) end parts of the grounded plate 24, that is, the parts facing to the edge parts of the web 14 supported on the roller 16 are bent to be closer to the web 14. The grounded plate 24 is made from a metal, e.g. aluminum, copper, iron, and stainless steal, or a nonmetallic conductor.

Figure 3:
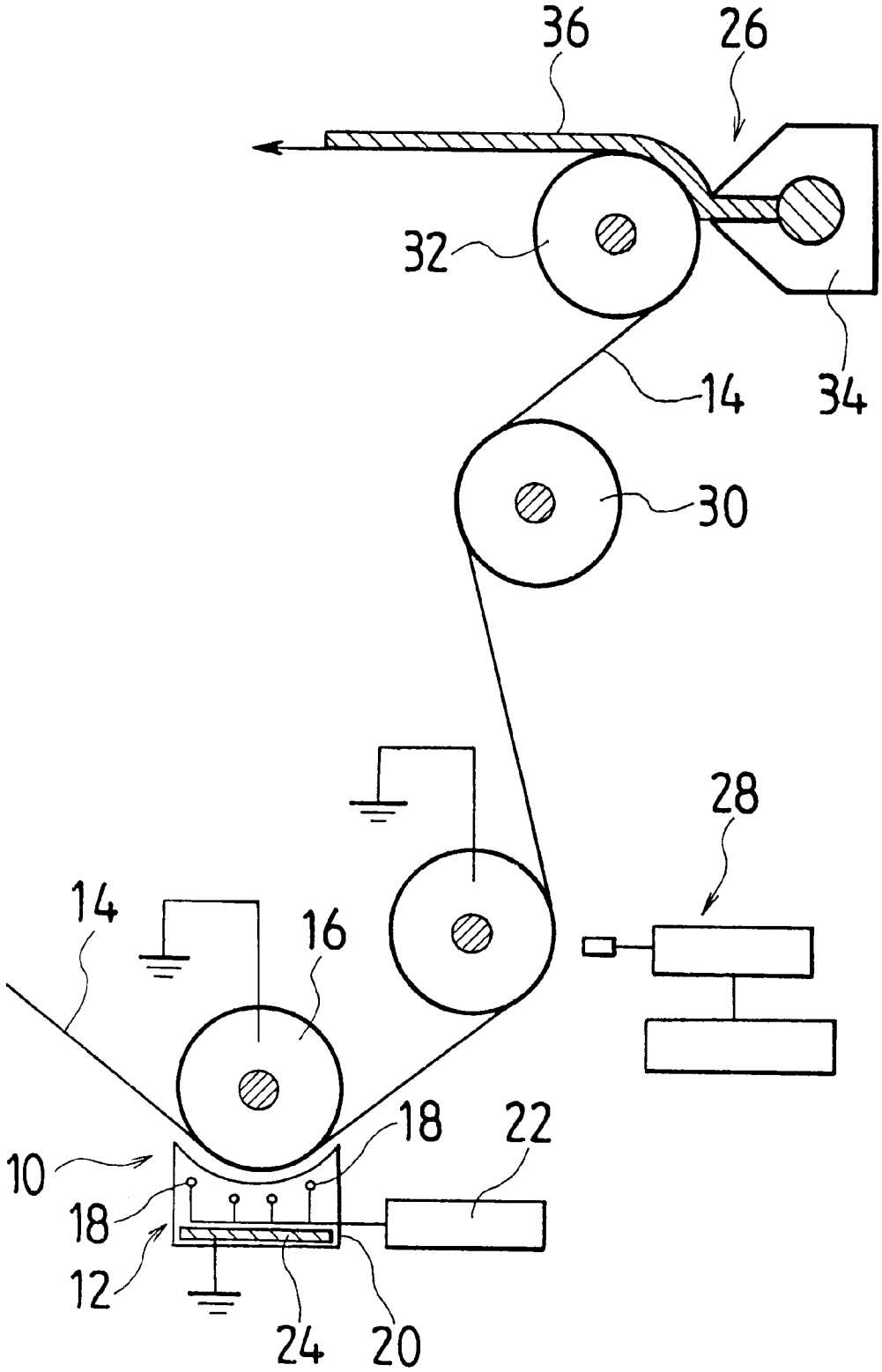
FIG. 3 is a view showing the path of a web in a coating system including the first embodiment of the web charging apparatus according to the present invention.

A description will be given of the operation of the web charging apparatus 10, which is constructed in the above-mentioned manner, with reference to FIG. 3 showing the path of the web 14 in a coating system that includes the web charging apparatus 10.

As shown in FIG. 3, the web 14 passes through the web charging apparatus 10, and then, it reaches a coating apparatus 26. In the web charging apparatus 10, the source 22 applies a high voltage to the wire electrodes 18 so that the corona discharge is established between the wire electrodes 18 and the roller 16 via the web 14. Thereby, unipolar electrostatic charges are deposited on the surface of the web 14. Then, the web 14 passes a surface electrometer 28, which measures and records a surface electrostatic potential on the web 14, and reaches the coating apparatus 26 via a pass roller 30. A coating head 34 of the coating apparatus 26 applies a coating solution 36 to the surface of the web 14 supported on a backup roller 32. Thus, the web 14 is coated with the coating solution 36.

During the coating operation, the web charging apparatus 10 deposits the unipolar electrostatic charges on the surface of the web 14, thereby improving the affinity and adhesion of the coating solution 36 to the web 14. Thus, the coating performance can be improved.

A conventional web charging apparatus has the problem of the "liquid exhaustion at the edge parts of the web" in that the edge parts of the web cannot satisfactorily be coated with the coating solution, since the electrostatic potential at the edge parts of the web is lower than the electrostatic potential at the central part of the web.

To solve the above-mentioned problem, the web charging apparatus 10 is provided with the grounded plate 24 behind the wire electrodes 18 relative to the roller 16. Thus, it is possible to prevent the electrostatic potential at the edge parts of the web 14 from becoming lower than the electrostatic potential at the central part of the web 14, so that the web 14 can be uniformly charged on the whole width thereof. By bending the lengthwise ends of the grounded plate 24 toward the web 14, it is easy to equalize the electrostatic potential at the edge parts and the central part of the web 14. Even if they are not bent, a satisfactory effect can also be achieved.

As stated above, the grounded plate 24 is provided behind the wire electrodes 18 relative to the roller 16, thereby equalizing the electrostatic potential at the edge parts and the central part of the web 14. That is because the intensity of the electrostatic field that is formed in the space between the wire electrodes 18 and the roller 16, is uniform over the whole width of the web 14. Thus, it is possible to prevent the "liquid exhaustion at the edge parts of the web" by providing the grounded plate 24.

In the web charging apparatus 10 according to the present invention, there is no necessity to finely adjust the distance between each wire electrode 18 and the web 14 by less than 1 mm, unlike the conventional web charging apparatus. It is also possible to prevent the sag of the wire electrodes 18 from affecting the electrostatic potential on the web 14, thereby equalizing the electrostatic potential at the edge parts and the central part of the web 14.

Figure 4:
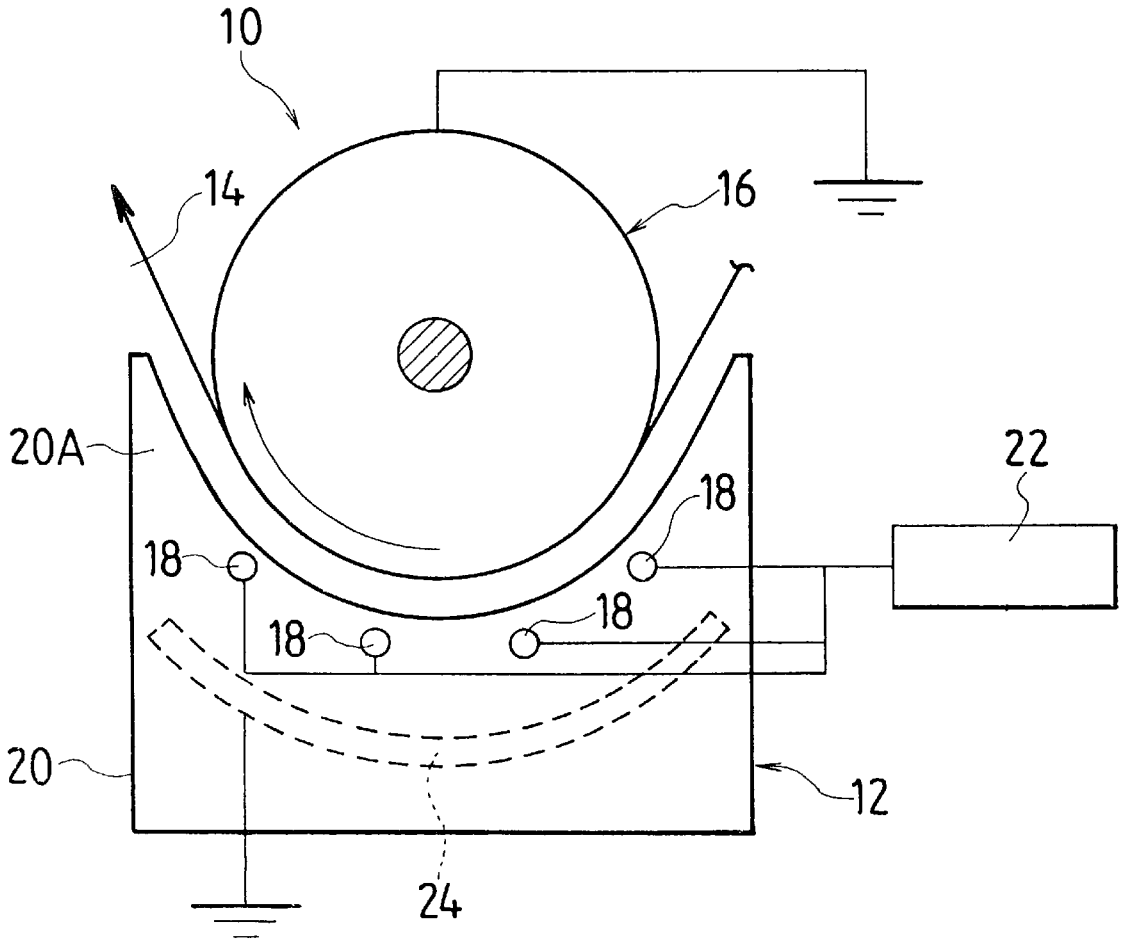
FIG. 4 is a side view of assistance in explaining the second embodiment of the web charging apparatus according to the present invention.

FIG. 4 is a side view of assistance in explaining the second embodiment of the web charging apparatus 10 according to the present invention, and parts similar to those of the first embodiment will be denoted by the same reference numerals.

In the second embodiment, the grounded plate 24 is curved along the periphery of the roller 16. Thereby, the distances between the grounded plate 24 and the wire electrodes 18, which are arranged in parallel at regular intervals along the path of the web 14, can be uniform. The intensity of the electrostatic field that is formed between the wire electrodes 18 and the web 14 can also be uniform in the direction in which the web 14 moves. Thus, it is possible to avoid a change in the electrostatic potential in the direction in which the web 14 moves, so that the web 14 can be uniformly coated in its moving direction.

Figure 5:
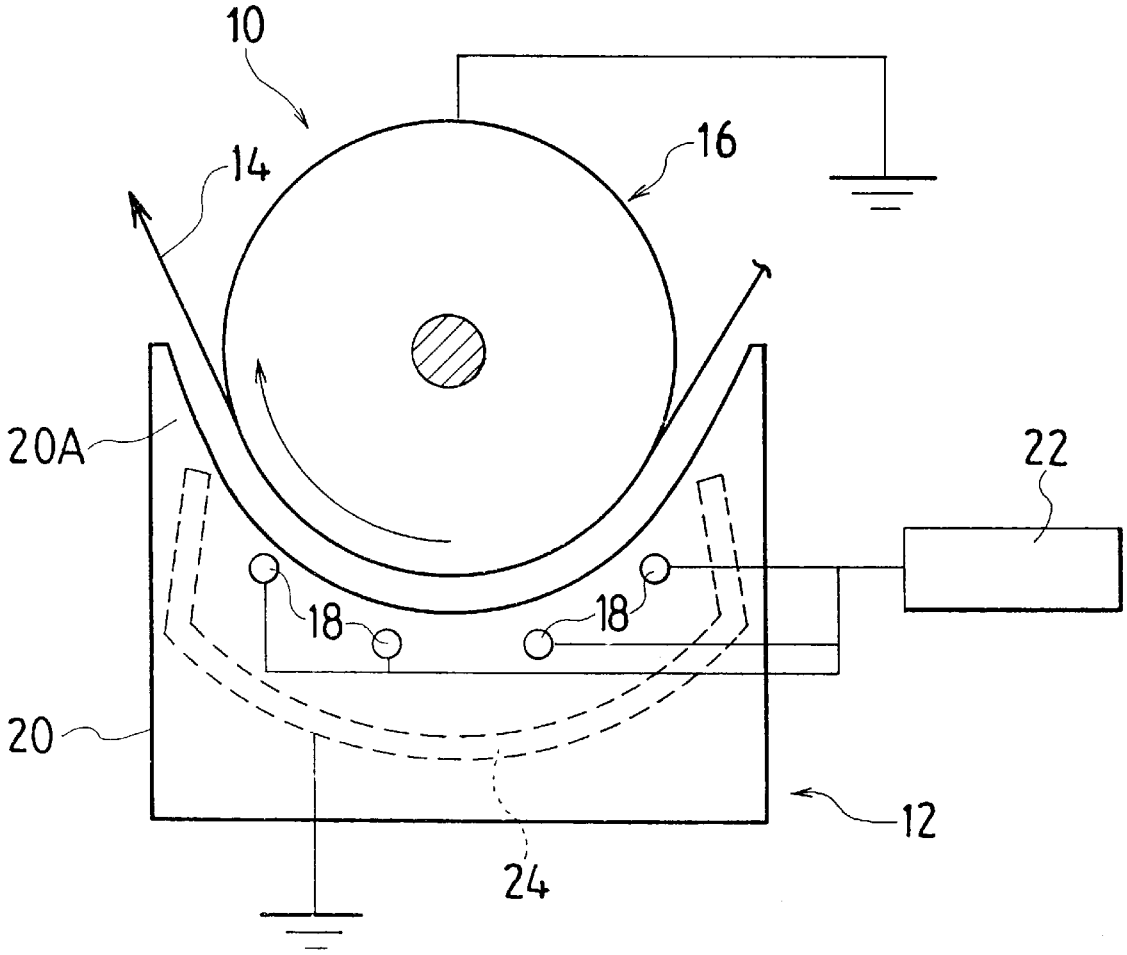
FIG. 5 is a side view of assistance in explaining the third embodiment of the web charging apparatus according to the present invention.

FIG. 5 is a side view of assistance in explaining the third embodiment of the web charging apparatus 10 according to the present invention, and parts similar to those of the first embodiment will be denoted by the same reference numerals.

In the third embodiment, the central part of the grounded plate 24 is curved along the periphery of the roller 16, and both widthwise end parts of the grounded plate 24 are bent toward the roller 16 in a manner to enclose the wire electrodes 18.

The third embodiment can achieve the same effects as the second embodiment, and besides, the wire electrodes 18 are enclosed by the grounded plate 24 to prevent the disturbance. Thus, the electrostatic field can be more stable.

Figure 6:
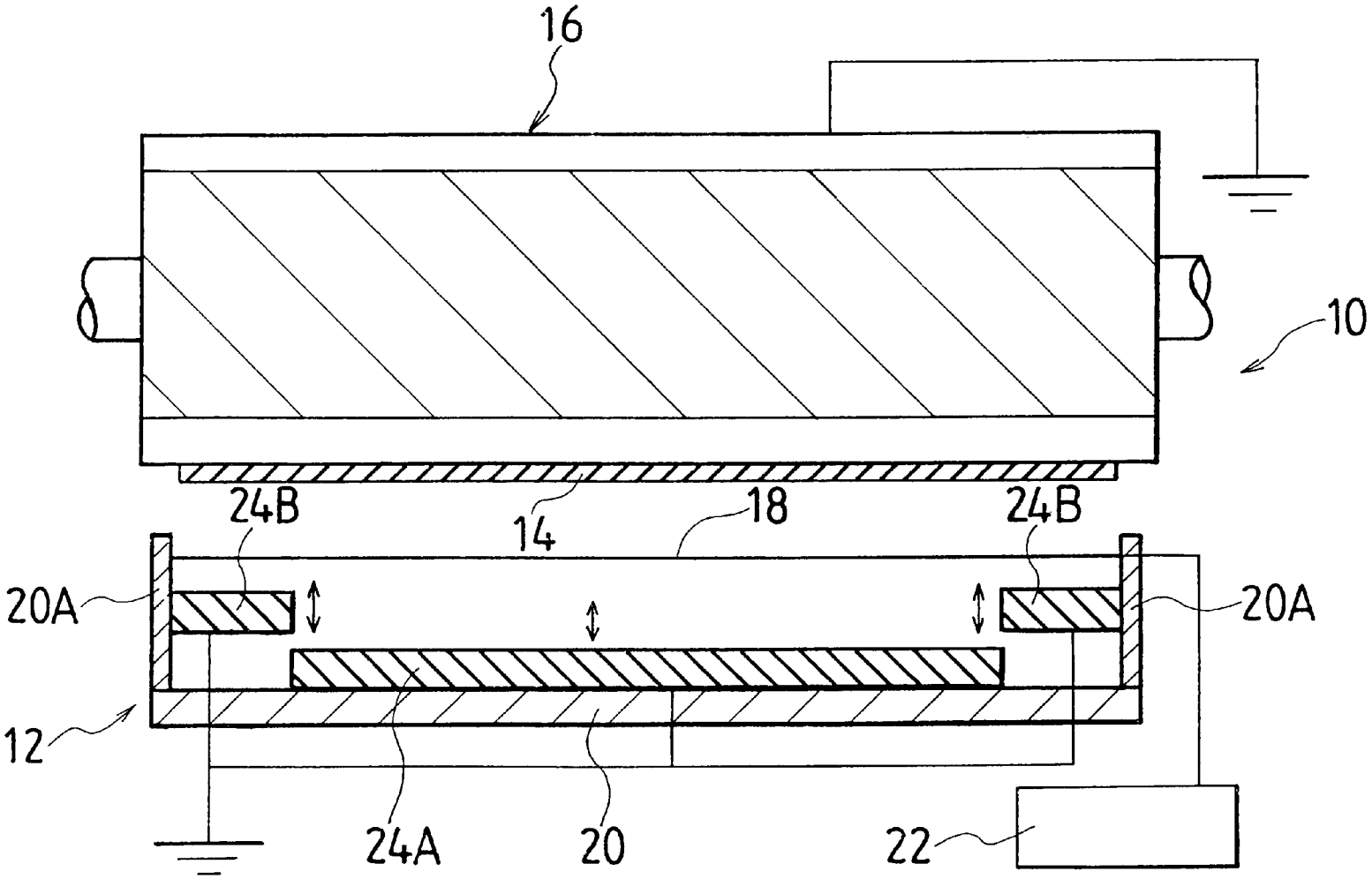
FIG. 6 is a front sectional view illustrating the fourth embodiment of the web charging apparatus according to the present invention.

FIG. 6 is a front sectional view of assistance in explaining the fourth embodiment of the web charging apparatus 10 according to the present invention, and parts similar to those of the first embodiment will be denoted by the same reference numerals.

In the fourth embodiment, the grounded plate 24 is separated into three grounded plates 24A and 24B. The grounded plate 24A is arranged to face the central part of the web 14, and the grounded plates 24B are arranged to face both edge parts of the web 14. Each of the grounded plates 24A and 24B is movable in the vertical direction in FIG. 6.

Unlike the first embodiment, there is no necessity to bend both lengthwise ends of the grounded plate 24. Moreover, it is possible to adjust the distances between the web 14 and the grounded plates 24B and between the web 14 and the grounded plate 24A independently of one another. Thus, it is possible to equalize the electrostatic potential at the edge parts and the central part of the web 14, or to intentionally make the electrostatic potential at the edge parts of the web 14 lower than the electrostatic potential at the central part of the web 14 to thereby decrease the coating solution applied on the edge parts of the web 14.

The grounded plate 24A facing the central part of the web 14 may be removed, so that the only grounded plates 24B are arranged to face the edge parts of the web 14.

Figure 7:
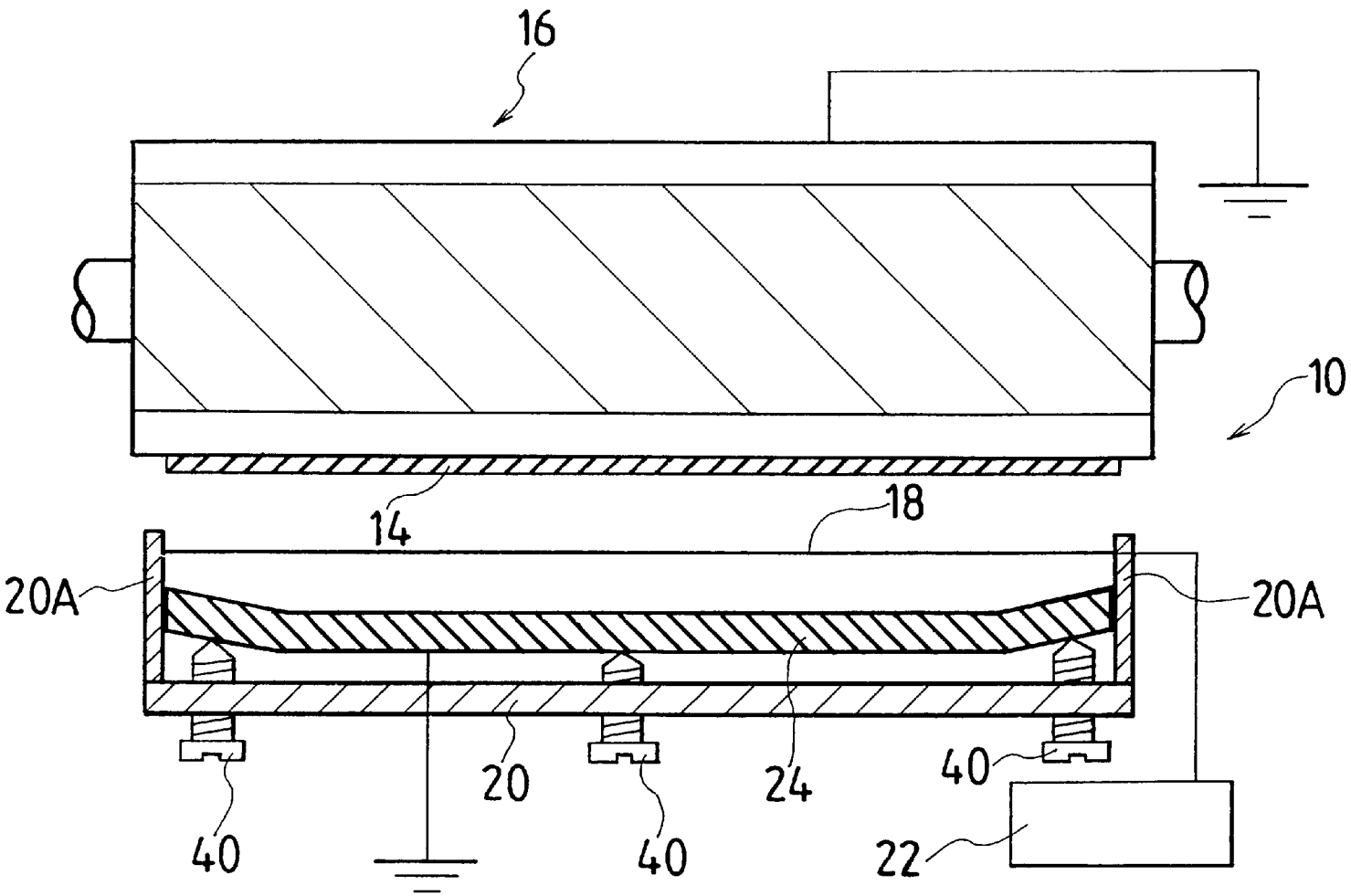
FIG. 7 is a front sectional view illustrating the fifth embodiment of the web charging apparatus according to the present invention.

FIG. 7 is a front sectional view of assistance in explaining the fifth embodiment of the web charging apparatus 10 according to the present invention, and parts similar to those of the first embodiment will be denoted by the same reference numerals.

In the fifth embodiment, the grounded plate 24 is provided with a distance adjusting device or bolts 40 that adjust the distance between the grounded plate 24 and the wire electrodes 18. Specifically, the ends of the bolts 40, which engage with a bottom plate of the electrode support frame 20, are in contact with the central part and the lengthwise end parts of the grounded plate 24. A material that elastically deforms easily is suitable for the grounded plate 24. The bolts 40 are pressed against the grounded plate 24, so that the distance between the grounded plate 24 and the web 14 can be finely adjusted so as to equalize the electrostatic potential at the edge parts and the central part of the web 14. The distance adjusting device for the grounded plate 24 are not restricted to the bolts 40, but air cylinders, etc. may be used. The number of the bolts 40 is not restricted to three.

In these embodiments, the first grounded electrode 16 functions as the supporting roller for the web 14, but the present invention should not be restricted to this. The first grounded electrode 16 may be an unrotative cylinder, a rod, a pipe, a plate, or a moving belt. The discharge electrode 18 should not be restricted to the wire, but may be a bristle brush. The number of the discharge electrodes 18 may be one. The second grounded electrode 24 should not be necessarily the rectangular plate. The second grounded electrode 24 may be any shape that does not disturb the electrostatic field between the wire electrodes 18 and the web 14. For example, the second grounded electrode 24 may be a plane as in the first embodiment and an arc as in the second embodiment. It may also be shaped in a manner to enclose the wire electrodes 18 as in the third embodiment and to vary the distance to the wire electrodes 18 as in the fourth and fifth embodiments. The second grounded electrode 24 may be a wire, a rod, a belt, or a grid.

EXPERIMENT

A description will be given of experiments with the coating system in FIG. 3 including the web charging apparatus 10 according to the present invention.

A web as the web 14 was made of TAC (triacetyl cellulose), coated with gelatin, 200 mm in width, and ordinarily used for a photographic film. The web 14 was transported at a speed of 100 m/min. In the web charging apparatus 10, four wires as the wire electrodes 18 were made of tungsten, 100 $\mu$m in diameter, and 200 mm in length. The wire electrodes 18 were arranged in parallel so that each distance to the web 14 was 10 mm. An aluminum plate was used as the grounded plate 24.

The power supply 22 applied a direct voltage of 6300 V to the wire electrodes 18, so that the corona discharge was established between the wire electrodes 18 and the web 14. Thereby, the unipolar electrostatic charges were deposited on the surface of the web 14. Then, the surface electrometer 28 measured the electrostatic potential on the charged surface of the web 14. After the measurement, the coating apparatus 26 applied the coating solution 36 on the web 14.

In the first experiment, the grounded plate 24 of 200 mm in length, just as the wire electrodes 18, was provided, and the distance between each wire electrode 18 and the grounded plate 24 was changed to 24 mm, 21 mm, 18 mm and 14 mm. The surface electrostatic potential on the web 14 was measured at the central part and the edge part, specifically, the point positioned inside by 20 mm from the widthwise end of the web 14. For a comparative example, the measurement was also performed in the case where no grounded plate was provided. The measurement result was represented with surface electrostatic potential ratio defined as follows:

$$\text{Surface electrostatic potential ratio} = \frac{\text{Surface electrostatic potential at the edge part}}{\text{Surface electrostatic potential at the central part}}.$$

TABLE 1 shows the result of the first experiment.

TABLE 1

| Distance between wire electrodes and grounded plate [mm] | Surface electrostatic potential ratio |
|---|---|
| 24 | 0.78 |
| 21 | 0.85 |
| 18 | 0.94 |
| 14 | 1.00 |
| No grounded plate was provided | 0.42 |

As shown in TABLE 1, the surface electrostatic potential ratio was approximately 1 when the grounded plate 24 was provided, whereas the ratio was 0.42 when the grounded plate 24 was not provided. There may be some fluctuations in the ratios according to conditions such as the shape of the grounded plate 24 and the voltage applied to the wire electrodes 18. When the distance between each wire electrode 18 and the grounded plate 24 was 14 mm under the above-mentioned conditions, the surface electrostatic potential ratio was 1, and the electrostatic potential at the edge parts and the central part of the web 14 was perfectly uniform. Thus, it was proved that it is possible to uniformly deposit the unipolar electrostatic charges on the whole width of the web 14 by providing the grounded plate 24.

Moreover, as is clear from the TABLE 1, even if the distance between each wire electrode 18 and the grounded plate 24 was changed from 14 mm to 18 mm, the surface electrostatic potential ratio slightly changed from 1 to 0.94. Thus, unlike the conventional web charging apparatus, there is no necessity to finely adjust the distance between each wire electrode 18 and the web 14 by less than 1 mm, and no trouble occurs even if the wire electrodes 18 are a little slack.

In the second experiment, the only grounded plates 24B of 20 mm in length were provided to face both edge parts of the web 14, and the other conditions were the same as in the first experiment. The distance between each wire electrode 18 and each grounded plate 24B was changed to 24 mm, 21 mm and 18 mm. The surface electrostatic potential on the web 14 was measured at the central part and the edge part thereof.

TABLE 2 shows the result of the second experiment.

TABLE 2

| Distance between wire electrodes and grounded plates [mm] | Surface electrostatic potential ratio |
|---|---|
| 24 | 1.23 |
| 21 | 1.27 |
| 18 | 1.50 |
| No grounded plate was provided | 0.42 |

As is clear from the TABLE 2, when the only grounded plates 24B were provided to face the edge parts of the web 14, the surface electrostatic potential at the edge parts tended to be higher than that at the central part. For this reason, if the only grounded plates 24B are provided, there must be extensive distances between the wire electrodes 18 and the grounded plates 24B. On the other hand, this tendency can be utilize for applying the coating solution 36 on the edge parts of the web 14 intentionally thicker than the central part.

In the third experiment, it was found whether the "liquid exhaustion at the edge parts of the web" arose or not, when the web 14 that had been processed in the first experiment was coated with the coating solution. TABLE 3 shows the result of the third experiment.

TABLE 3

| Distance between wire electrodes and grounded plate [mm] | Liquid exhaustion at the edge parts of the web |
|---|---|
| 24 | Not arising |
| 21 | Not arising |
| 18 | Not arising |
| 14 | Not arising |
| No grounded plate was provided | Arising |

As shown in TABLE 3, if no grounded plate was provided as conventional, that is, if the surface electrostatic potential ratio was 0.42, the "liquid exhaustion at the edge parts of the web" arose. On the other hand, if the grounded plate 24 was provided according to the present invention, that is, if the surface electrostatic potential ratio was between 0.78 and 1.00, the "liquid exhaustion at the edge parts of the web" did not arise.

As set forth hereinabove, according to the web charging apparatus of the present invention, the unipolar electrostatic charges can be uniformly deposited on the whole width of the web, and thus, it is possible to equalize the affinity and adhesion of the coating solution applied on the edge parts and the central part of the web.

For the reasons stated above, it is possible to avoid the so-called "liquid exhaustion at the edge parts of the web" in that the edge parts of the web cannot be coated satisfactorily compared with the central part of the web.

Moreover, the coating apparatus utilizing the web charging apparatus according to the present invention can intentionally coat the edge parts of the web thicker than the central part.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A web charging apparatus comprising:

a first grounded electrode being a roller contacting a whole width of a first surface of a moving continuous web;

a discharge electrode facing said first grounded electrode across the web;

a second grounded electrode arranged behind said discharge electrode relative to said first grounded electrode; and an adjuster for moving said second grounded electrode to adjust a distance between said discharge electrode and said second grounded electrode such that a distance between said discharge electrode and said second grounded electrode at a lengthwise central part of said discharge electrode facing a widthwise central part of the web is larger than a distance between said discharge electrode and said second grounded electrode at two distal end parts of said discharge electrode facing widthwise edge parts of the web;

wherein a corona discharge is established between said first grounded electrode and said discharge electrode via the web by which electrostatic charges are deposited on a second surface of the web; and wherein said web charging apparatus is arranged at an upstream side of a coating apparatus continuously coating the web with a coating solution.

2. The web charging apparatus as defined in claim 1, wherein said second grounded electrode faces a substantially whole width of the web.

3. The web charging apparatus as defined in claim 1, wherein said second grounded electrode faces only both widthwise edge parts of the web.

4. The web charging apparatus as defined in claim 1, wherein said second grounded electrode is at least one plate.

5. The web charging apparatus as defined in claim 1, wherein said discharge electrode is at least one wire.

6. The web charging apparatus as defined in claim 1, wherein said adjuster moves said second grounded electrode at a plurality of positions along a lengthwise direction of said discharge electrode.

7. The web charging apparatus as defined in claim 1, wherein said adjuster moves said second grounded electrode to at least three positions along a lengthwise direction of said discharge electrode.

8. The web charging apparatus as defined in claim 1, wherein said adjuster bends said second grounded electrode.

9. The web charging apparatus as defined in claim 1, wherein said adjuster moves said second grounded electrode to adjust the corona discharge such that a ratio of surface electrostatic potential at the widthwise edge parts of the web to a surface electrostatic potential at the widthwise central part of the web is not less than 0.78 and not more than 1.5.

10. A web charging apparatus comprising:

a first grounded electrode being a roller contacting a whole width of a first surface of a moving continuous web;

a discharge electrode facing said first grounded electrode across the web;

a second grounded electrode arranged behind said discharge electrode relative to said first grounded electrode; and an adjuster for moving said second grounded electrode at a plurality of positions along a lengthwise direction of said discharge electrode to adjust distances between said discharge electrode and said second grounded electrode at the plurality of positions, respectively, such that a distance between said discharge electrode and said second grounded electrode at a lengthwise central part of said discharge electrode facing a widthwise central part of the web is larger than a distance between said discharge electrode and said second grounded electrode at two distal end parts of said discharge electrode facing widthwise edge parts of the web;

wherein a corona discharge is established between said first grounded electrode and said discharge electrode via the web by which electrostatic charges are deposited on a second surface of the web; and wherein said web charging apparatus is arranged at an upstream side of a coating apparatus continuously coating the web with a coating solution.

11. The web charging apparatus as defined in claim 10, wherein said discharge electrode is at least one wire.

12. The web charging apparatus as defined in claim 10, wherein said adjuster moves said second grounded electrode to adjust the corona discharge such that a ratio of surface electrostatic potential at the widthwise edge parts of the web to a surface electrostatic potential at the widthwise central part of the web is not less than 0.78 and not more than 1.5.

13. A web charging apparatus comprising:

a first grounded electrode being a roller contacting a whole width of a first surface of a moving continuous web;

a discharge electrode facing said first grounded electrode across the web; and a second grounded electrode having a horizontal central portion and two distal ends, said second grounded electrode being arranged behind said discharge electrode, relative to said first grounded electrode, both of said distal ends of said second grounded electrode being bent toward the web;

wherein a corona discharge is established between said first grounded electrode and said discharge electrode via the web by which electrostatic charges are deposited on a second surface of the web, such that a ratio of surface electrostatic potential at widthwise edge parts of the web to a surface electrostatic potential at a widthwise central part of the web is not less than 0.78 and not more than 1.5; and wherein said web charging apparatus is arranged at an upstream side of a coating apparatus continuously coating the web with a coating solution.

14. The web charging apparatus as defined in claim 13, wherein said discharge electrode ia at least one wire.

* * * * *